US011849517B1

(12) United States Patent
Mignoli et al.

(10) Patent No.: US 11,849,517 B1
(45) Date of Patent: Dec. 19, 2023

(54) DETECTING ERROR CONDITIONS IN A PLURALITY OF LED CHANNELS

(71) Applicant: Infineon Technologies AG, Neubiberg (DE)

(72) Inventors: Franco Mignoli, Verona (IT); Adolfo De Cicco, Castel d'Azzano (IT); Damiano Sartori, Padua (IT); Luca Mengani, Tarragona (ES); Christopher Gabriel, Villach (AT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 18/055,342

(22) Filed: Nov. 14, 2022

(51) Int. Cl.
*H05B 45/50* (2022.01)
*H05B 45/24* (2020.01)
*H05B 45/44* (2020.01)

(52) U.S. Cl.
CPC ..... *H05B 45/50* (2020.01); *H05B 45/24* (2020.01); *H05B 45/44* (2020.01)

(58) Field of Classification Search
None
See application file for complete search history.

(56) References Cited

U.S. PATENT DOCUMENTS

2013/0099702 A1* 4/2013 Williams ..... H05B 47/18 315/363
2016/0360144 A1* 12/2016 Williams ..... H04N 5/57
2022/0174883 A1* 6/2022 Adams ..... H05B 45/3725

OTHER PUBLICATIONS

U.S. Appl. No. 17/654,372, filed Mar. 10, 2022, naming inventors Montemurro et al.

* cited by examiner

*Primary Examiner* — Anh Q Tran
(74) *Attorney, Agent, or Firm* — Shumaker & Sieffert, P.A.

(57) ABSTRACT

In some examples, this disclosure describes a light-emitting diode (LED) driver circuit configured to: control a set of LED channels; receive, from each LED channel of the set of LED channels, channel status information that indicates whether the respective LED channel is activated or deactivated; and determine, based on the channel status information corresponding to each LED channel of the set of LED channels, a channel status of the respective LED channel. Additionally, the LED driver circuit is configured to output, to a master computing device, the channel status corresponding to each LED channel of the set of LED channels; and output, to the master computing device, channel mapping information, wherein the master computing device is configured to determine, based on the channel status information and the channel mapping information, whether one or more error conditions are present in the set of LED channels.

21 Claims, 8 Drawing Sheets

700

| | 702 | | | | 704 | | | | 706 | | | | 708 | | | | 710 | | | | 712 | | | | 714 | | | |
|---|---|---|---|---|---|---|---|---|---|---|---|---|---|---|---|---|---|---|---|---|---|---|---|---|---|---|---|---|
| | Normal | | | | LED Short | | | | Open LED | | | | HS Short to Battery | | | | CS Short to Battery | | | | HS Short to Ground | | | | CS Short to Battery | | | |
| HS | ON | | OFF | | ON | | OFF | | ON | | OFF | | ON | | OFF | | ON | | OFF | | ON | | OFF | | ON | | OFF | |
| LS | ON | OFF | ON | OFF | ON | OFF | ON | OFF | ON | OFF | ON | OFF | ON | OFF | ON | OFF | ON | OFF | ON | OFF | ON | OFF | ON | OFF | ON | OFF | ON | OFF |
| VF WD | 2.85 | 0 | 0 | -1.6 | 0 | 0 | 0 | 0 | VS | 0 | 0 | -1.6 | 2.85 | 0 | 2.85 | 0 | 3.55 | 3.55 | 0 | 0 | 0 | -1.77 | 0 | -1.87 | 0 | 0 | -2 | -2 |
| VOUT | VS-2.85 | VS | 0 | 4.8 | VS | VS | 0 | 6.3 | 0 | VS | 0 | 4.8 | VS-2.85 | VS | VS-2.85 | VS | 0 | 0 | 0 | 0 | 0 | 2 | 0 | 1.87 | VS | VS | VS | VS |
| VHS | VS | VS | 0 | 3.2 | VS | VS | 0 | 6.3 | VS | VS | 0 | 3.2 | VS | VS | VS | VS | 3.74 | 3.74 | 0 | 0 | 0 | 0 | 0 | 0 | VS | VS | 7 | 7 |

FIG. 7

DETECTING ERROR CONDITIONS IN A PLURALITY OF LED CHANNELS

TECHNICAL FIELD

This disclosure relates circuits for driving, controlling, and monitoring light-emitting diodes.

BACKGROUND

Driver circuits are often used to control a voltage, current, or power at a load. For instance, a light-emitting diode (LED) driver may control the power supplied to a string of light-emitting diodes. In some cases, LED driver circuits may accept an input signal including an input current and an input voltage and deliver an output signal including an output current and an output voltage. In some such cases, an LED driver circuit may regulate at least some aspects of the input signal and the output signal, such as controlling the output current emitted by the LED driver circuit. In some examples, processing circuitry may control one or more driver circuits to control a set of LEDs, and monitor one or more parameters associated with the set of LEDs

SUMMARY

In general, this disclosure is directed to devices, systems, and techniques for detecting one or more error conditions in a plurality of light-emitting diode (LED) channels. For example, each LED channel of the one or more LED channels may include one or more sensors that are configured to detect channel status information corresponding to the respective LED channel. The sensors corresponding to each LED channel may output the channel status information to an LED driver circuit, and the LED driver circuit may output the channel status information to a master computing device. The master computing device may be configured to determine, based on the channel status information, whether one or more error conditions are present in the set of LED channels. The master computing device may output information corresponding to the one or more error conditions.

The techniques of this disclosure may provide one or more advantages. For example, by outputting channel status information to a master computing device, the system described herein may eliminate a need for the driver circuit to include processing circuitry to identify error conditions. The master computing device may be configured to monitor whether error conditions are present in each LED channel of the set of LED channels, and respond to identified error conditions. For example, the master computing device may deactivate one or more LED channels associated with detected error conditions.

In some examples, an LED driver circuit is configured to: control a set of LED channels; receive, from each LED channel of the set of LED channels, channel status information that indicates whether the respective LED channel is activated or deactivated; determine, based on the channel status information corresponding to each LED channel of the set of LED channels, a channel status of the respective LED channel; output, to a master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

In some examples, a method comprises controlling, by an LED driver circuit, a set of LED channels; receiving, by the LED driver circuit from each LED channel of the set of LED channels, channel status information that indicates whether the respective LED channel is activated or deactivated; determining, by the LED driver circuit based on the channel status information corresponding to each LED channel of the set of LED channels, a channel status of the respective LED channel; outputting, by the LED driver circuit to a master computing device, the channel status corresponding to each LED channel of the set of LED channels; outputting, by the LED driver circuit to the master computing device, channel mapping information, wherein the channel mapping information indicates an LED driver of a set of LED drivers corresponding to each LED channel of the set of LED channels; and determining, by the master computing device based on the channel status information and the channel mapping information, whether one or more error conditions are present in the set of LED channels.

In some examples, a system comprises: a set of LED channels; a master computing device; and an LED driver circuit configured to: control the set of LED channels; receive, from each LED channel of the set of LED channels, channel status information that indicates whether the respective LED channel is activated or deactivated; determine, based on the channel status information corresponding to each LED channel of the set of LED channels, a channel status of the respective LED channel; output, to the master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

The summary is intended to provide an overview of the subject matter described in this disclosure. It is not intended to provide an exclusive or exhaustive explanation of the systems, devices, and methods described in detail within the accompanying drawings and description below. Further details of one or more examples of this disclosure are set forth in the accompanying drawings and in the description below. Other features, objects, and advantages will be apparent from the description and drawings, and from the claims.

BRIEF DESCRIPTION OF THE DRAWINGS

FIG. 7 is a conceptual diagram illustrating a table indicating a set of LED channel status conditions, in accordance with one or more techniques of this disclosure.

Like reference characters denote like elements throughout the description and figures.

DETAILED DESCRIPTION

Light-emitting diodes (LEDs) may emit light when one or more LEDs of a set of LEDs are activated. In some examples, the set of LEDs may be arranged in a formation and one or more LED driver circuits may control the LEDs to achieve a desired output. For example, the one or more LED driver circuits may control whether each LED of the set of LEDs is activated or deactivated. In some examples, a master computing device may control each LED driver circuit of the one or more LED driver circuits. Each LED of the set of LEDs may, in some examples, correspond to an LED channel of the set of LED channels. Each LED channel may include one or more sensors configured to generate channel status information. The master computing device may receive this channel status information via the one or more LED driver circuits and determine whether one or more error conditions are present.

Figure 1:
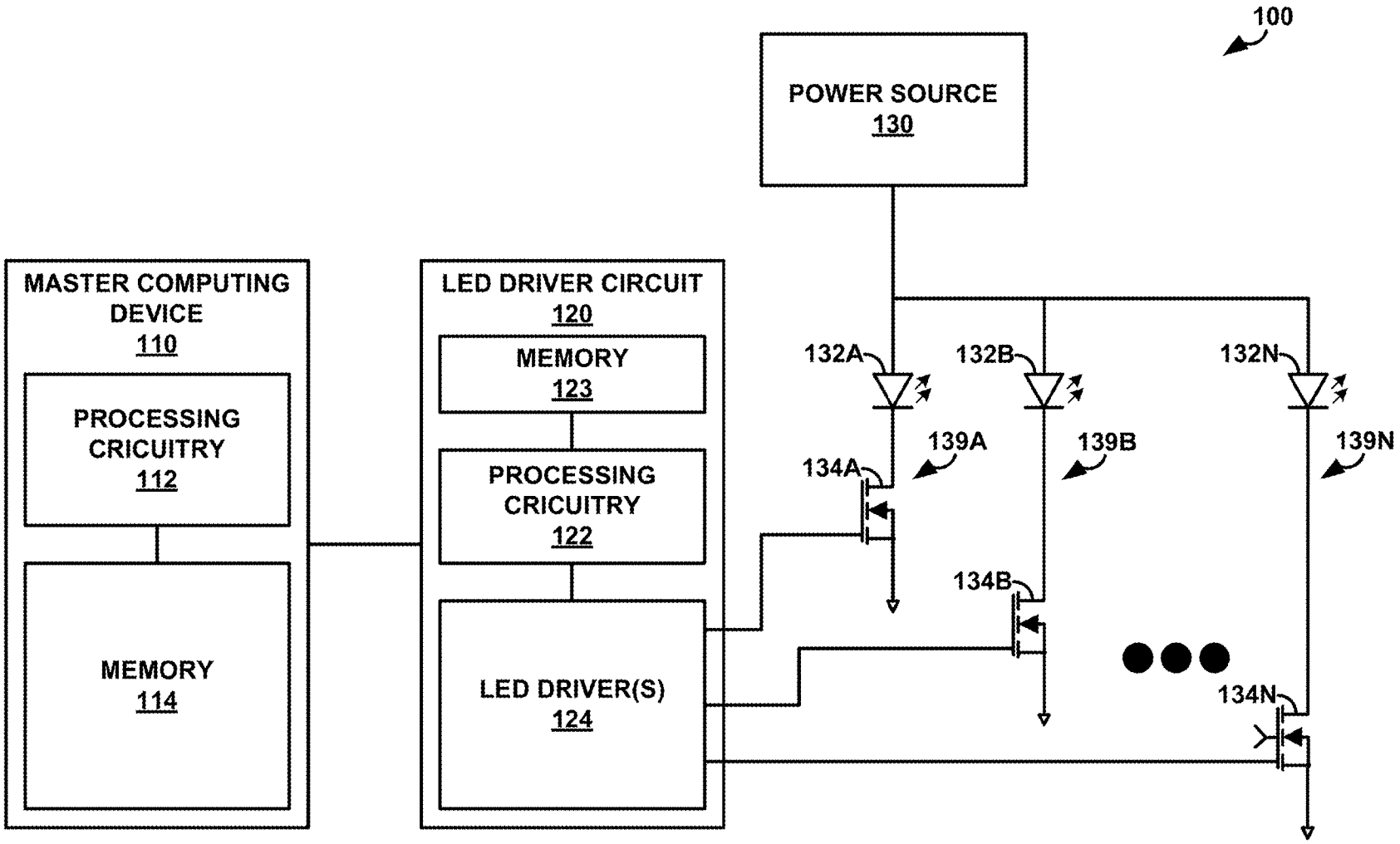
FIG. 1 is a block diagram illustrating first example system for controlling and monitoring one or more LEDs, in accordance with one or more techniques of this disclosure.

FIG. 1 is a block diagram illustrating first example system 100A for controlling and monitoring one or more LEDs, in accordance with one or more techniques of this disclosure. As seen in FIG. 1, system 100A includes master computing device 110, LED driver circuit 120, power source 130, LEDs 132A-132N (collectively, "LEDs 132"), switching devices 134A-134N (collectively, "switching devices 134"). LED driver circuit 120 includes processing circuitry 122, memory 123, and LED driver(s) 124. Each LED channel of LED channels 139A-139N (collectively, "LED channels 139") may correspond to a respective LED of LEDs 132 and a respective switching device of switching devices 134. In some examples, LED driver(s) 124 may include an LED driver corresponding to each switching device of switching devices 134.

Master computing device 110 may include processing circuitry 112. Processing circuitry 112 may include, for example, one or more microprocessors, digital signal processors (DSPs), application specific integrated circuits (ASICs), field-programmable gate arrays (FPGAs), or equivalent discrete or integrated logic circuitry, or a combination of any of the foregoing devices or circuitry. Accordingly, the processing circuitry 112 of master computing device 110 may include any suitable structure, whether in hardware, software, firmware, or any combination thereof, to perform the functions ascribed herein to system 100A.

Master computing device 110 may include a memory 114 in communication with the processing circuitry 112 of master computing device 110. In some examples, the memory in communication with the processing circuitry 112 includes computer-readable instructions that, when executed by the processing circuitry 112, cause system 100A to perform various functions attributed to system 100A herein. The memory 114 may include any volatile, non-volatile, magnetic, optical, or electrical media, such as a random access memory (RAM), read-only memory (ROM), non-volatile RAM (NVRAM), electrically-erasable programmable ROM (EEPROM), flash memory, or any other digital media capable of storing information.

In some examples, master computing device 110 may control LED driver circuit 120 to control LEDs 132 to achieve a desired output. For example, master computing device 110 may control LED driver circuit 120 to control whether each LED of LEDs 132 is activated or deactivated. To achieve the desired output, master computing device 110 may control one or more parameters of each LED of LEDs 132. For example, a duty cycle of an LED may determine an amount of light emitted by the LED. Master computing device 110 may control a duty cycle of each LED of LEDs 132.

LED driver circuit 120 may include processing circuitry 122. Processing circuitry 122 may include, for example, microprocessors, DSPs, ASICs, FPGAs, or equivalent discrete or integrated logic circuitry, or a combination of any of the foregoing devices or circuitry. Accordingly, processing circuitry 122 may include any suitable structure, whether in hardware, software, firmware, or any combination thereof, to perform the functions ascribed herein to system 100A.

LED driver circuit 120 may include a memory 123 in communication with processing circuitry 122. In some examples, the memory in communication with the processing circuitry includes computer-readable instructions that, when executed by processing circuitry 122, cause LED driver circuit 120 to perform various functions attributed to LED driver circuit 120 herein. Memory 123 may include any volatile, non-volatile, magnetic, optical, or electrical media, such as RAM, ROM, NVRAM, EEPROM, flash memory, or any other digital media. In some examples not illustrated in FIG. 1, LED driver circuit 120 includes processing circuitry without including a memory.

LED driver circuit 120 may include one or more LED driver(s) 124. Each LED driver of the LED driver(s) 124 may control whether a respective LED of LEDs 132 is activated or deactivated. In some examples, master computing device 110 output one or more instructions to LED driver circuit 120. LED driver circuit 120 may control, based on the one or more instructions, LED driver(s) 124. LED driver(s) 124 may control whether each LED 132 is activated or deactivated. In some examples, LED driver(s) 124 may include an LED driver corresponding to each LED of LEDs 132. Each LED driver of LED driver(s) 124 may include circuitry configured to output one or more control signals.

Power source 130 may supply electrical energy to LEDs 132. In some examples, power source 130 includes a battery and a power generation circuit to produce operating power. In some examples, power source 130 is rechargeable to allow extended operation. Power source 130 may include any one or more of a plurality of different battery types, such as nickel cadmium batteries and lithium ion batteries. In some examples, a maximum voltage output of power source 130 is approximately 12V. In some examples, power source 130 supplies power within a range from 10 Watts (W) to 15 W. In some examples, power source 130 represents a source other than a battery.

In some examples, LEDs 132 may include any one or more suitable semiconductor light sources. In some examples, each LED of LEDs 132 may include a p-n junction configured to emit light when activated. In some examples, LEDs 132 may be included in a headlight assembly for automotive applications. For instance, LEDs 132 may include a matrix, a string, or more than one string of light-emitting diodes to light a road ahead of a vehicle. As used herein, a vehicle may refer to motorcycles, trucks, boats, golf carts, snowmobiles, heavy machines, or any type of vehicle that uses directional lighting. In some examples, LEDs 132 include one or more high beam (HB) LEDs and one or more low beam (LB) LEDs. LED driver circuit 120 may toggle between activating the one or more LB LEDs, activating the one or more HB LEDs, activating both the one or more LB LEDs and the one or more HB LEDs, and deactivating both the one or more LB LEDs and the one or more HB LEDs. LEDs 132 may include any number of LEDs. For example, LEDs 132 may include a number of LEDs within a range from 1 to 100 LEDs.

As seen in FIG. 1, LED driver(s) 124 may be configured to control switching devices 134. Each switching device of switching devices 134 may, in some cases, include a power switch such as, but not limited to, any type of field-effect transistor (FET) including any one or combination of a metal-oxide-semiconductor field-effect transistor (MOSFET), a bipolar junction transistor (BJT), an insulated-gate bipolar transistor (IGBT), a junction field effect transistor (JFET), a high electron mobility transistor (HEMT), or other kinds of elements that use voltage or current for control. Additionally, each of switching devices 134 may include any one or combination of n-type transistors, p-type transistors, and power transistors. In some examples, each of switching devices 134 includes vertical transistors, lateral transistors, and/or horizontal transistors. In some examples, each of switching devices 134 includes other analog devices such as diodes and/or thyristors. In some examples, each of switching devices 134 may operate as a switch and/or operate as an analog device.

In some examples, each of switching devices 134 includes three terminals: two load terminals and a control terminal. When a switching device of switching devices 134 represents a MOSFET, the switching device may include a drain terminal, a source terminal, and at least one gate terminal, where the control terminal is a gate terminal. When a switching device of switching devices 134 represents a BJT switch, the control terminal may represent a base terminal. Current may flow between the two load terminals of the switching device, based on the voltage at the respective control terminal. Therefore, electrical current may flow across the switching device based on control signals delivered to the control terminal of the switching device. In one example, if a voltage applied to the control terminal of the switching device is greater than or equal to a voltage threshold, the switching device may be activated, allowing the switching device to conduct electricity. Furthermore, the switching device may be deactivated when the voltage applied to the control terminal of the switching device is below the threshold voltage, thus preventing the switching device from conducting electricity. Processing circuitry 122, master computing device 110, or any combination thereof may be configured to control each of switching devices 134.

Each of switching devices 134 may include various material compounds, such as Silicon, Silicon Carbide, Gallium Nitride, or any other combination of one or more semiconductor materials. In some examples, silicon carbide switches may experience lower switching power losses. Improvements in magnetics and faster switching, such as Gallium Nitride switches, may allow a switching device to draw short bursts of current. These higher frequency devices may require control signals (e.g., voltage signals delivered to the control terminal of the switching device) to be sent with more precise timing, as compared to lower-frequency devices.

LED channels 139 may each correspond to a respective LED of LEDs 132 and a switching device of switching devices 134. To control whether each LED of LEDs 132 is activated or deactivated, LED driver circuit 120 may control the switching device of switching devices 134 corresponding to the respective LED channel of LED channels 139 that also corresponds to the respective LED of LEDs 132. For example, LED driver circuit 120 may control switching device 134A of LED channel 139A to control LED 132A, LED driver circuit 120 may control switching device 134B of LED channel 139B to control LED 132B, and LED driver circuit 120 may control switching device 134N of LED channel 139N to control LED 132N.

LED driver circuit 120 is configured to control LED channels 139. LED driver(s) 124 may include an LED driver corresponding to each LED channel of LED channels 139. For example, an LED driver of LED driver(s) 124 may control a gate terminal of switching device 134A, an LED driver of LED driver(s) 124 may control a gate terminal of switching device 134A, and so on. In some examples, when an LED driver of LED driver(s) 124 controls a switching device of switching device(s) 134 to activate, the LED corresponding to the switching device emits light. For example, when an LED driver of LED driver(s) 124 activates switching device 134A, LED 132A may emit light, when an LED driver of LED driver(s) 124 activates switching device 134B, LED 132B may emit light, and so on.

According to this disclosure, LED driver circuit 120 may receive, from each LED channel LED channels 139, channel status information that indicates whether the respective LED channel 139 is activated or deactivated. When an LED channel is activated, the LED corresponding to the LED channel emits light. For example, when LED 132A emits light, LED channel 139A may be activated. In some examples, the channel status information represents signals from one or more sensors of LED channels 139. The information may include one or more parameters that indicate whether the respective LED is emitting light, a voltage across the respective switching device, a voltage across the respective LED, a voltage at the gate terminal of the respective switching device, or any combination thereof.

Processing circuitry 122 of LED driver circuit 120 may be configured to determine, based on the channel status information corresponding to each LED channel of the set of LED channels 139, a channel status of each channel of the set of LED channels 139. The channel status may include information indicative of whether the respective LED channel is activated or deactivated. The channels status of an LED channel may represent an actual state of the LED channel that is comparable against a desired state of the LED channel. For example, when the actual state of an LED channel does not match a desired state of an LED channel, this may indicate that an error condition is present at the LED channel. In some examples, the channel status for an LED channel may include all the information received from sensors at the respective of LED channel.

Processing circuitry 122 may output, to master computing device 110, the channel status corresponding to each LED channel of the set of LED channels 139. For example, processing circuitry 122 may output all the channel status information received from LED channels 139 to master computing device 110. Processing circuitry 122 may, in some examples, output data in addition to the channel status information including an indication of whether each LED channel of LED channels 139 is activated or deactivated.

In some examples, processing circuitry 122 may output, to the master computing device 110, channel mapping information. The channel mapping information may indicate an LED driver of the set of LED drivers 124 corresponding to each LED channel of LED channels 139. For example, the channel mapping information may indicate that a first LED driver of LED drivers 124 controls the gate terminal of switching device 134A, the channel mapping information may indicate that a second LED driver of LED drivers 124 controls the gate terminal of switching device 134B, and so on. In some examples, the channel mapping information may include data in addition to or alternatively to the LED driver corresponding to each LED channel. For example, the channel mapping information may indicate a desired color corresponding to each LED channel of the set of LED channels 139. The desired color may be indicated with red, green, and blue (RGB) color data. In some examples, the channel mapping information indicates a physical position corresponding to each LED channel of the set of LED channels 139. That is, LEDs 132 may be arranged in an LED formation, where each LED of LEDs 132 occupies a physical position on the LED formation. The channel mapping information may indicate the physical position of the LED of each LED channel on the LED formation.

Processing circuitry 112 of master computing device 110 is configured to determine, based on the channel status information and the channel mapping information, whether one or more error conditions are present in the set of LED channels 139. For example, processing circuitry 112 of master computing device 110 may translate the channel mapping information into desired channel status information, wherein the desired channel status information indicates one or more LED channel status parameters for achieving a desired output corresponding to the set of LED channels 139. Processing circuitry 112 may compare the channel status information with the desired channel status information to determine whether the one or more error conditions are present in the set of LED channels 139. In other words, processing circuitry 112 may compare the actual status of the LED channels 139 as indicated by the channel status information with the desired status of the LED channels 139 as determined by translating the channel mapping information into desired channel status information.

The desired output may represent a desired output of light from the set of LEDs 132 corresponding to the set of LED channels 139. For example, the desired output may represent a desired amount of light output from the set of LEDs 132, one or more desired colors of light output from the set of LEDs 132, a desired message to be displayed from the set of LEDs 132, or any combination thereof. The desired output may represent any desired appearance of the light output from the set of LEDs 132. The one or more LED channel status parameters for achieving the desired output may represent one or more parameters for controlling the set of LED channels 139 to achieve the desired output. For example, the one or more LED channel status parameters may include one or more LED control parameters for controlling of LED channels 139. The one or more control parameters may include, for example, a duty cycle corresponding to each LED channel of LED channels 139.

In some examples, based on determining that the one or more error conditions are present in the set of LED channels 139, the master computing device 110 may be configured to output information indicating the one or more error conditions. The information indicating the one or more error conditions may represent a source of each error condition of the one or more error conditions. In some examples, the information indicating the source of each error condition may indicate an LED channel of the set of LED channels 139 associated with each error conditions of the one or more error conditions. In some examples, the information indicating the source of each error condition may indicate a cause of each error condition of the one or more error conditions. For example, error conditions may be caused by short connections. The information indicating the source of each error condition may identify a short connection causing each error condition of the one or more error conditions.

Master computing device 110 may, in some cases, perform one or more actions based on identifying the one or more error conditions. For example, processing circuitry 112 of master computing device 110 may identify one or more LED channels of the set of LED channels 139 corresponding to the one or more error conditions present in the set of LED channels 139. Master computing device 110 may, in some examples, deactivate the one or more LED channels associated with the one or more error conditions. By deactivating the one or more LED channels of LED channels 139 associated with the one or more error conditions, master computing device 110 pay prevent a possibility that the one or more error conditions will cause one or more LED channels to activate when a desired output of LED channels 139 require the one or more LED channels to be deactivated.

In some examples, to deactivate the one or more LED channels associated with the one or more error conditions, processing circuitry 112 of master computing device 110 may be configured to disconnect each LED channel of the one or more LED channels from power source 130. For examples, there may be a set of power source switching devices (not illustrated in FIG. 1) located between power source 130 and LED channels 139. A power source switching device of the set of power switching devices may be located between each LED channel of the set of LED channels 139. Processing circuitry 112 may control the set of power source switching devices to disconnect each LED channel of the one or more LED channels associated with an error condition from the power source 130.

In some examples, to deactivate the one or more LED channels associated with the one or more error conditions, processing circuitry 112 of master computing device 110 is configured to activate a safety switch of each LED channel of the one or more LED channels. For example, each LED channel of LED channels 139 may include a safety switch that is configured to prevent the respective LED channel from emitting light when the safety switch is activated. This may allow processing circuitry 112 of master computing device 110 to individually deactivate each LED channel of LED channels 139 based on whether the LED channel is associated with an error condition.

Figure 2:
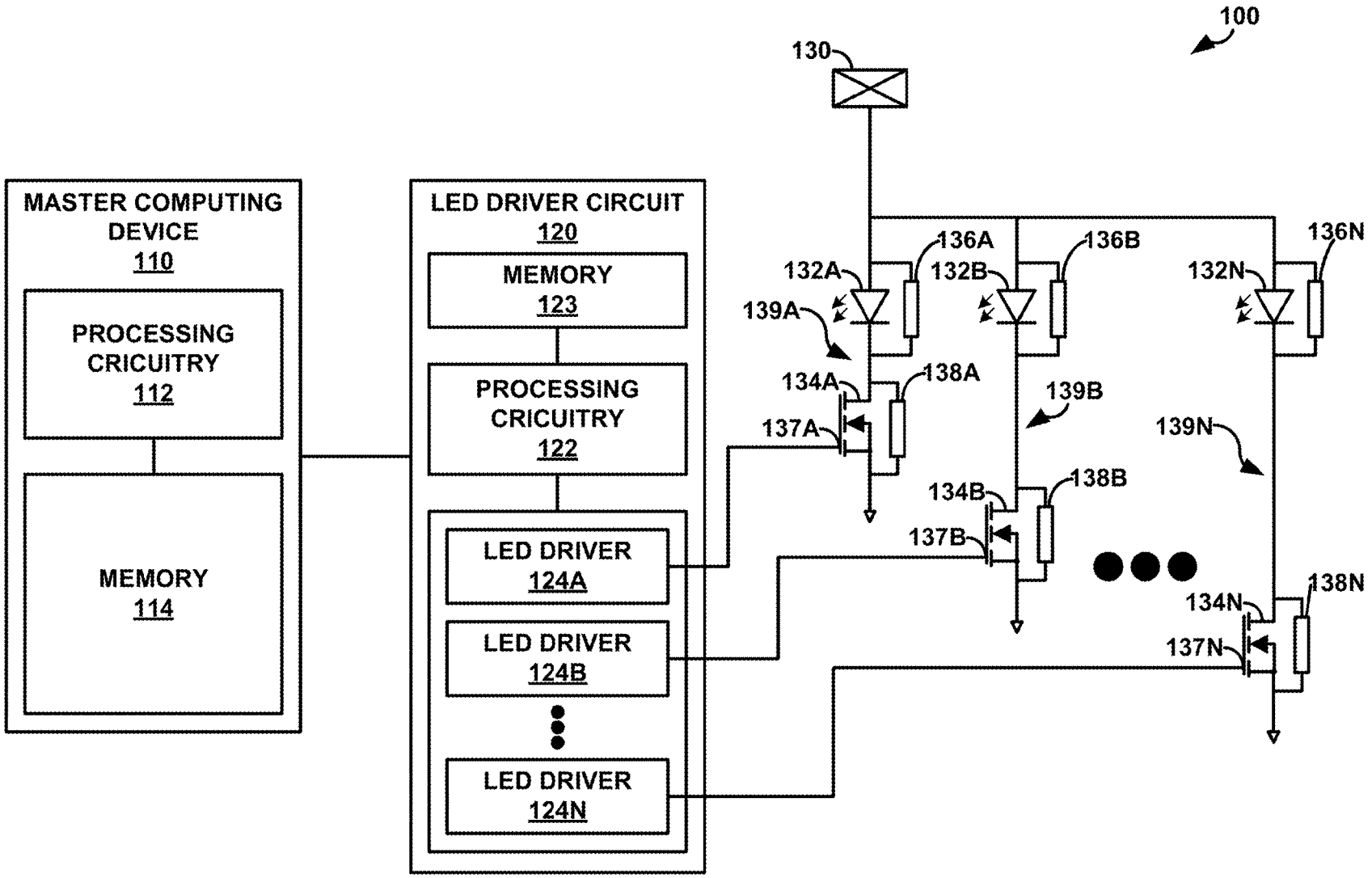
FIG. 2 is a block diagram illustrating a second example system for controlling and monitoring one or more LEDs, in accordance with one or more techniques of this disclosure.

FIG. 2 is a block diagram illustrating a second example system 100B for controlling and monitoring one or more LEDs, in accordance with one or more techniques of this disclosure. As seen in FIG. 1, system 100B includes master computing device 110, LED driver circuit 120, power source 130, LEDs 132A-132N (collectively, "LEDs 132"), switching devices 134A-134N (collectively, "switching devices 134"), LED voltage sensors 136A-136N (collectively, "LED voltage sensors 136"), gate voltage sensors 137A-137N (collectively, "gate voltage sensors 137"), and switching device voltage sensors 138A-138N (collectively, "switching device voltage sensors 138"). System 100B includes a set of LED channels 139A-139N (collectively, "LED channels 139").

Each LED channel of LED channels 139 may correspond to a respective LED of LEDs 132, a respective switching device of switching devices 134, a respective LED voltage sensor of LED voltage sensors 136, a respective gate voltage sensor of gate voltage sensors 137, and a respective switching device voltage sensor of switching device voltage sensors 138. LED driver circuit 120 includes processing circuitry 122, memory 123, and LED drivers 124A-124N (collectively, "LED drivers 124"). System 100B may be substantially the same as system 100A of FIG. 1, except that system 100B includes sensors 136, 137, 138, and system 100B illustrates an LED driver of LED drivers 124 corresponding to each LED channel of LED channels 139.

LED driver circuit 120 may receive, from each LED channel of the set of LED channels 139, channel status information that indicates whether the respective LED channel 139 is activated or deactivated. The channel status information may, in some examples, include one or more signals from LED voltage sensors 136, gate voltage sensors 137, and switching device voltage sensors 138.

In some examples, to receive the channel status information, LED driver circuit 120 is configured to receive, from each LED voltage sensor of the set of LED voltage sensors 136, an LED voltage signal that indicates a voltage across an LED corresponding to the respective LED channel of LED channels 139. For example, LED driver circuit 120 may receive an LED voltage signal from LED voltage sensor 136A indicating a voltage across LED 132A, LED driver circuit 120 may receive an LED voltage signal from LED voltage sensor 136B indicating a voltage across LED 132B, and so on.

In some examples, to receive the channel status information, LED driver circuit 120 is configured to receive, from each gate voltage sensor of the set of gate voltage sensors 137, a gate voltage signal that indicates a voltage at the gate terminal of the respective switching device of switching devices 134. For example, LED driver circuit 120 may receive a gate voltage signal from gate voltage sensor 137A indicating a voltage at the gate terminal of switching device 134A, LED driver circuit 120 may receive a gate voltage signal from gate voltage sensor 137B indicating a voltage at the gate terminal of switching device 134B, and so on.

In some examples, to receive the channel status information, LED driver circuit 120 may be configured to receive, from each switching device voltage sensor of the set of switching device voltage sensors 138, a switching device voltage signal that indicates a voltage at across the respective switching device of switching devices 134. For example, LED driver circuit 120 may receive a switching device voltage signal from switching device voltage sensor 138A indicating a voltage across switching device 134A, LED driver circuit 120 may receive a switching device voltage signal from switching device voltage sensor 138B indicating a voltage across switching device 134B, and so on.

Processing circuitry 112 may determine the channel status for each LED channel of the set of LED channels 139 based on the gate voltage signal, switching device voltage signal, and LED voltage signal corresponding to the respective LED channel of the set of LED channels 139. In some examples, the channel status for each LED channel of the set of LED channels 139 includes an indication of whether the respective LED channel is activated or deactivated. In some examples, the channel status for each LED channel of the set of LED channels 139 includes an indication of whether the respective LED channel is activated or deactivated.

In some examples, switching devices 134 and sensors 136, 137, 138 may be integrated within LED drivers 124. That is, switching device 134A and sensors 136A, 137A, 138A may be integrated within LED driver 124A, switching device 134B and sensors 136B, 137B, 138B may be integrated within LED driver 124B, and so on. In some examples, switching devices 134 and sensors 136, 137, 138 may be separate from LED drivers 124 as illustrated in FIG. 2.

Figure 3:
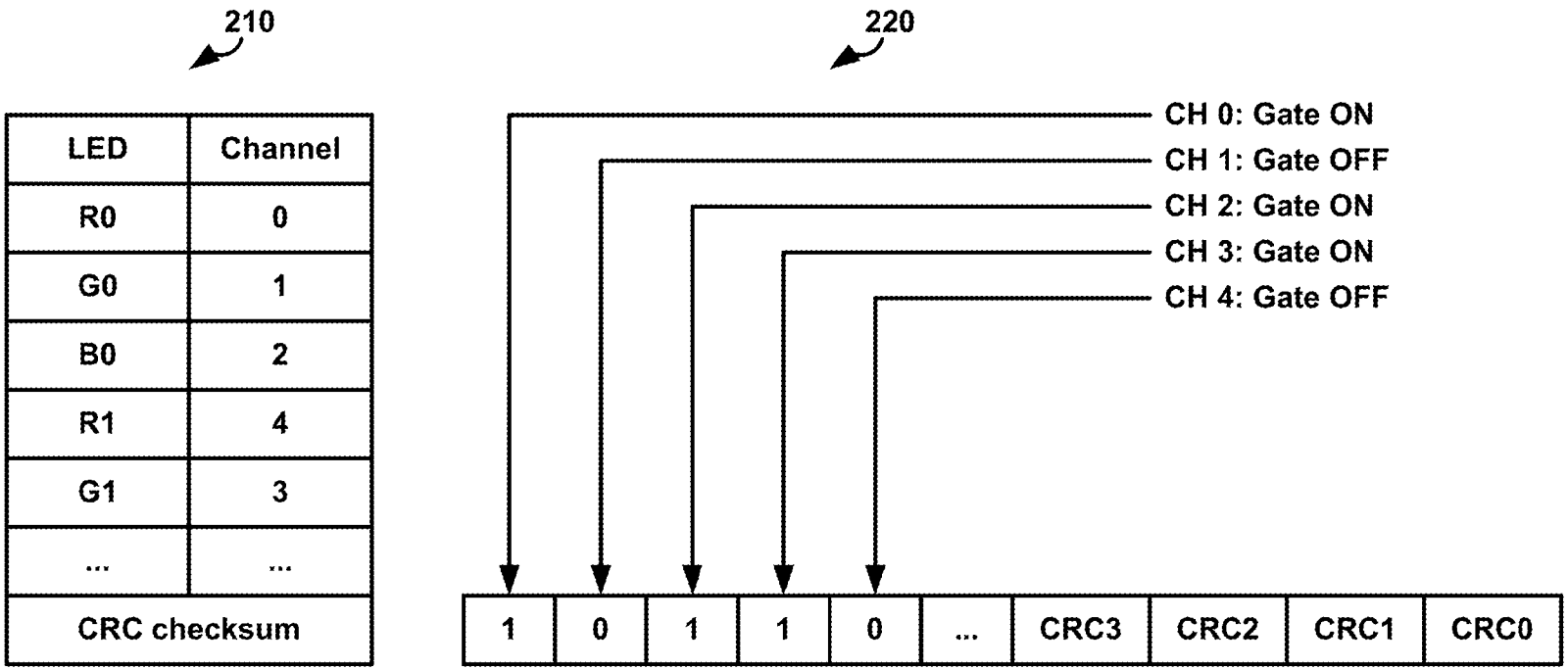
FIG. 3 is a conceptual diagram illustrating example channel mapping information and example channel status information, in accordance with one or more techniques of this disclosure.

FIG. 3 is a conceptual diagram illustrating example channel mapping information 210 and example channel status information 220, in accordance with one or more techniques of this disclosure. In some examples, channel mapping information 210 may represent channel mapping information that LED driver circuit 120 outputs to master computing device 110. In some examples, channel status information 220 may represent channel status information that LED driver circuit 120 outputs to master computing device 110 based on data received from sensors 136, 137, 138 of LED channels 139.

As seen in FIG. 3, channel mapping information 210 may indicate an LED channel of LED channels 139 corresponding to each LED of a set of LEDs 132. In some examples, each LED channel of LED channels 139 corresponds to a respective LED driver of LED drivers 124. This means that by indicating the LED channel of LED channels 139 corresponding to each LED of the set of LEDs 132, the channel mapping information may indicate an LED driver of LED drivers 124 corresponding to each LED of the set of LEDs 132. Although the channel mapping information 210 indicates a color of each LED of the set of LEDs 132 (e.g., R, G, and B), channel mapping information 210 may additionally or alternatively indicate a physical position of the respective LED on an LED formation.

Channel status information 220 may indicate a channel status corresponding to each LED channel of the set of LED channels 139. As seen in FIG. 3, channel status information 220 indicates a gate status ("ON" or "OFF") corresponding to each switching device of switching devices 134. In some examples, LED driver circuit 120 may determine the gate status corresponding to each switching device of switching devices 134 based on data received from sensors 136, 137, 138. For example, gate voltage signals received from gate voltage sensors 137 and switching device voltage signals received from switching device voltage sensors 138 may indicate whether each switching device of switching devices 134 is "ON" or "OFF." LED driver circuit 120 may output channel status information 220 to master computing device 110 including an indication of whether each switching device of switching devices 134 is "ON" or "OFF." Additionally, or alternatively, channel status information 220 may indicate whether each LED of LEDs 132 is activated or deactivated.

In some examples, the channel status mapping information 210 may represent automotive safety integrity level (ASIL) channel mapping information. In some examples, channel status information 220 may represent ASIL channel status information. LED driver circuit 120 may output channel mapping information 210 and channel status information 220 to master computing device 210 including one or more data protection mechanisms. The one or more data protection mechanisms may include cyclic redundancy check (CRC), alive counter, identification, or any combination thereof.

Figure 4:
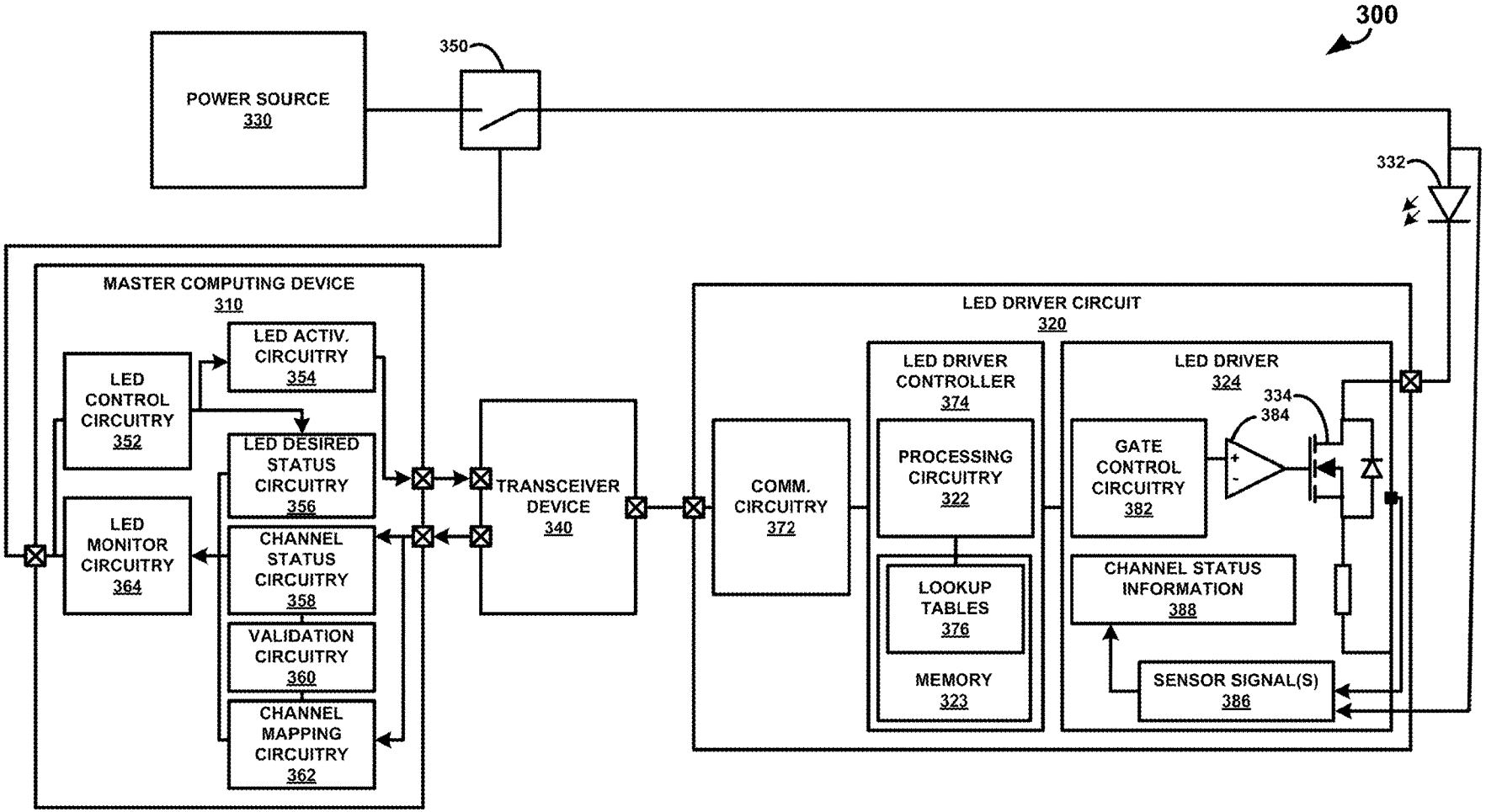
FIG. 4 is a block diagram illustrating a system including a first safety mechanism for deactivating one or more LEDs, in accordance with one or more techniques of this disclosure.

FIG. 4 is a block diagram illustrating a system 300 including a first safety mechanism for deactivating one or more LEDs, in accordance with one or more techniques of this disclosure. As seen in FIG. 3, system 300 includes master computing device 310, LED driver circuit 320, power source 330, LED 332, transceiver device 340, and safety switch 350. Master computing device 310 includes LED control circuitry 352, LED activation circuitry 354, LED desired status circuitry 356, channel status circuitry 358, validation circuitry 360, channel mapping circuitry 362, and LED monitor circuitry 364. LED driver circuit 320 includes LED driver 324, communication circuitry 372, and LED driver controller 374. LED driver controller 374 includes processing circuitry 322 and memory 323. Memory 323 is configured to store lookup tables 376. LED driver 324 includes switching device 334, gate control circuitry 382, amplifier 384, sensor signal(s) 386, and channel status information 388.

In some examples, master computing device 310 may be an example of master computing device 110 of FIGS. 1-2. In some examples, LED driver circuit 320 may be an example of LED driver circuit 120 of FIGS. 1-2. In some examples, LED driver 324 may represent an example of one of LED driver(s) 124 of FIGS. 1-2. In some examples, power source 330 may be an example of power source 130 of FIGS. 1-2. In some examples, LED 332 may be an example of one of LEDs 132 of FIGS. 1-2. In some examples, switching device 334 may be an example of one of switching devices 134 of FIGS. 1-2. There may exist LED channels in addition to the LED channel corresponding to LED 332 and switching device 334. In some examples, LED driver circuit 320 may include an LED driver corresponding to each LED channel of a set of LED channels, as seen in FIG. 2.

Master computing device 310 and/or LED driver circuit 320 may, in some cases, be configured to control one or more LED channels. In some examples, an LED channel may correspond to LED 332 and switching device 334. LED control circuitry 352 and/or LED activation circuitry 354 may transmit one or more LED control signals to transceiver device 340. These one or more LED control signals may be for controlling LED 332 to occupy a desired state. LED control circuitry 352 may, in some examples, transmit the desired status for LED 332 to LED desired status circuitry 356. In some examples, LED desired status circuitry 356 may transmit the desired status to channel mapping circuitry.

Transceiver device 340 may send the one or more control signals received from master computing device to LED driver circuit 320 via communication circuitry 372. Communication circuitry 372 may transmit the one or more control signals to LED driver controller 374. Processing circuitry 322 may control a gate terminal of switching device 334 on order to control LED 332 to occupy a desired state. For example, processing circuitry 322 may output one or more signals to gate control circuitry 382 of LED driver 324, and gate control circuitry 382 may control the gate terminal of switching device 334 via amplifier 384. In some examples, LED 332 may emit light when switching device 334 is activated, and LED 332 may not emit light when switching device 334 is deactivated. A voltage at the gate terminal of switching device 334 may determine whether switching device 334 is activated or deactivated. Gate control circuitry 382 may control the voltage at the gate terminal of switching device 334 to achieve the desired state of LED 332.

In some examples, LED driver 324 may receive one or more sensor signal(s) 386 from one or more sensors of the LED channel corresponding to LED 332 and switching device 334. Sensor signal(s) 386 may, in some examples, include a gate voltage signal indicating a voltage at the gate terminal of switching device 334, a switching device voltage signal indicating a voltage across switching device 334, an LED voltage signal corresponding to a voltage across LED 332, or any combination thereof. These sensor signal(s) 386 may represent channel status information 388 indicating an actual status of the LED channel corresponding to LED 332 and switching device 334. The actual status of the LED channels may, in some examples, reflect the desired status of the LED channel indicated by the one or more control signals sent from master computing device 310. In some examples, the actual status of the LED channel may differ from the actual status of the LED channel, meaning that an error condition is present in the LED channel.

Led driver 324 may send the channel status information 388 to LED driver controller 374. Processing circuitry 322 may, in some examples, determine a channel status of the LED channel based on the channel status information 388. Processing circuitry 322 may retrieve from lookup tables 376 stored by memory 323, channel mapping information. The channel mapping information may indicate that LED driver 324 and switching device 334 correspond to LED 332. LED driver 324 may output the channel status information and the channel mapping information to master computing device 310 via communication circuitry 372 and transceiver device 340.

Channel status circuitry 358 may receive the channel status information and the channel mapping information. Channel status circuitry 358, validation circuitry 360, and/or channel mapping circuitry 362 may process the channel mapping information, the channel status information, and the desired status received from LED control circuitry 352 to determine whether one or more error conditions are present in the LED channel. If one or more error conditions are present in the LED channel, LED monitor circuitry 364 may control safety switch 350 to disconnect LED 332 from power source 330. This may prevent LED 332 from emitting light when the desired status of LED 332 is to be deactivated.

In some examples, system 302 may include a set of LED channels, including the LED channel corresponding to LED 332 and switching device 334. In some examples, switch corresponding to each LED channel of the set of LED channels between the power source 330 and a respective LED of a set of LEDs. This means that each LED channel of the set of LED channels may correspond to a switch that can disconnect the respective LED from power source 330. Master computing device 310 may individually control the switches to deactivate one or more LED channels associated with error conditions detected by master computing device 310.

Figure 5:
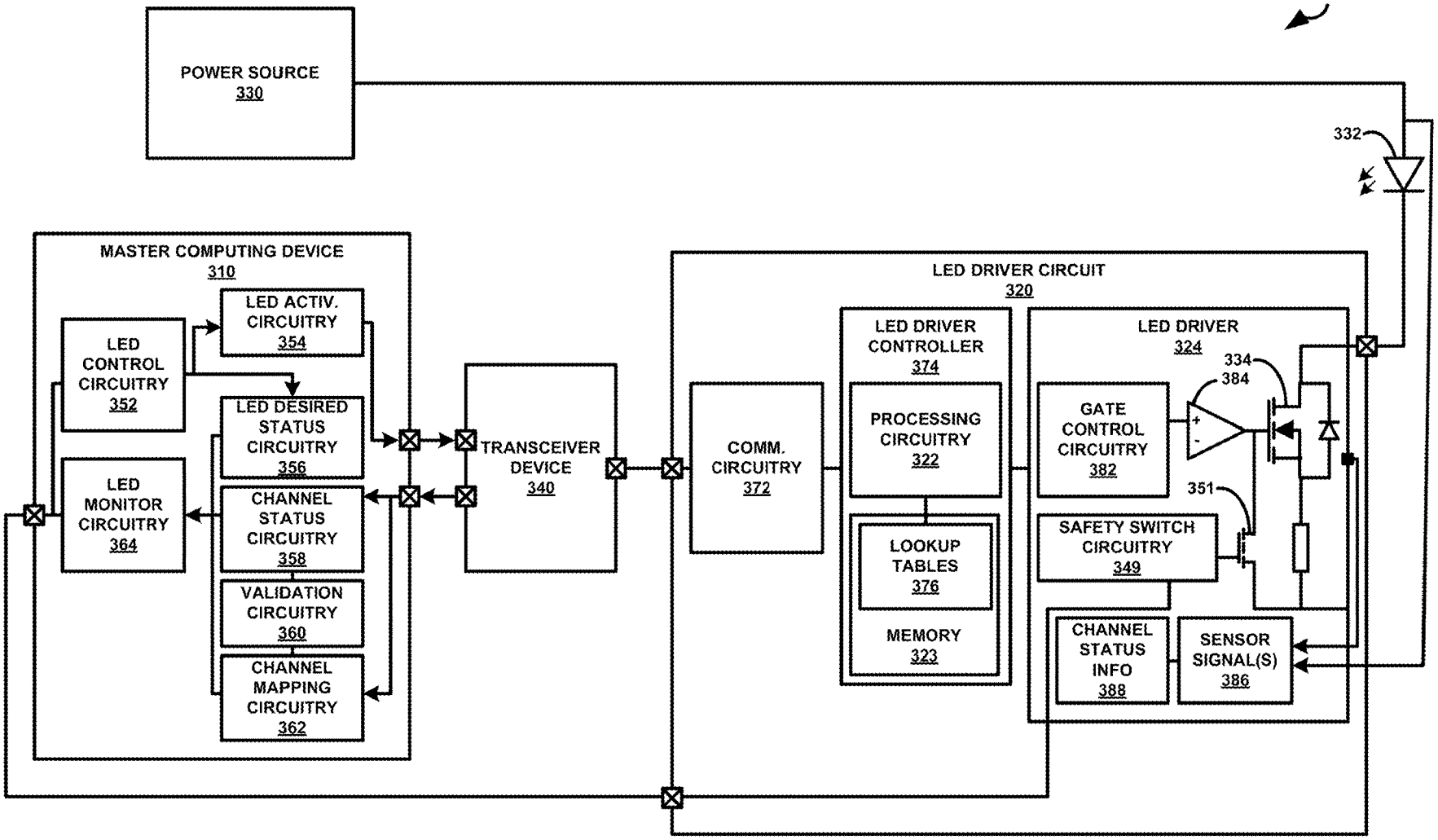
FIG. 5 is a block diagram illustrating a system including a second safety mechanism for deactivating one or more LEDs, in accordance with one or more techniques of this disclosure.

FIG. 5 is a block diagram illustrating a system 302 including a second safety mechanism for deactivating one or more LEDs, in accordance with one or more techniques of this disclosure. As seen in FIG. 3, system 300 includes master computing device 310, LED driver circuit 320, power source 330, LED 332, transceiver device 340, and safety switch 350. Master computing device 310 includes LED control circuitry 352, LED activation circuitry 354, LED desired status circuitry 356, channel status circuitry 358, validation circuitry 360, channel mapping circuitry 362, and LED monitor circuitry 364. LED driver circuit 320 includes LED driver 324, communication circuitry 372, and LED driver controller 374. LED driver controller 374 includes processing circuitry 322 and memory 323. Memory 323 is configured to store lookup tables 376. LED driver 324 includes switching device 334, gate control circuitry 382, amplifier 384, sensor signal(s) 386, and channel status information 388.

In some examples, system 302 of FIG. 5 may be substantially the same as system 300 of FIG. 4, except that system 302 may include safety switch circuitry 349 and safety switch 350 as a safety mechanism instead of a switch between power source 330 and LED 332. For example, based on identifying one or more error conditions present in an LED channel corresponding to LED 332 and switching device 334, master computing device 310 may output one or more signals to safety switch circuitry 349 to cause safety switch 351 to activate. When safety switch 351 is activated, switching device 334 may deactivate.

In some examples, system 302 may include a set of LED channels, including the LED channel corresponding to LED 332 and switching device 334. In some examples, LED driver circuit 320 may include an LED driver corresponding to each LED channel of the set of LED channels. This means that each LED channel of the set of LED channels may correspond to a safety switch of an LED driver. Master computing device 310 may individually control the safety switches to deactivate one or more LED channels associated with error conditions detected by master computing device 310.

Figure 6A:
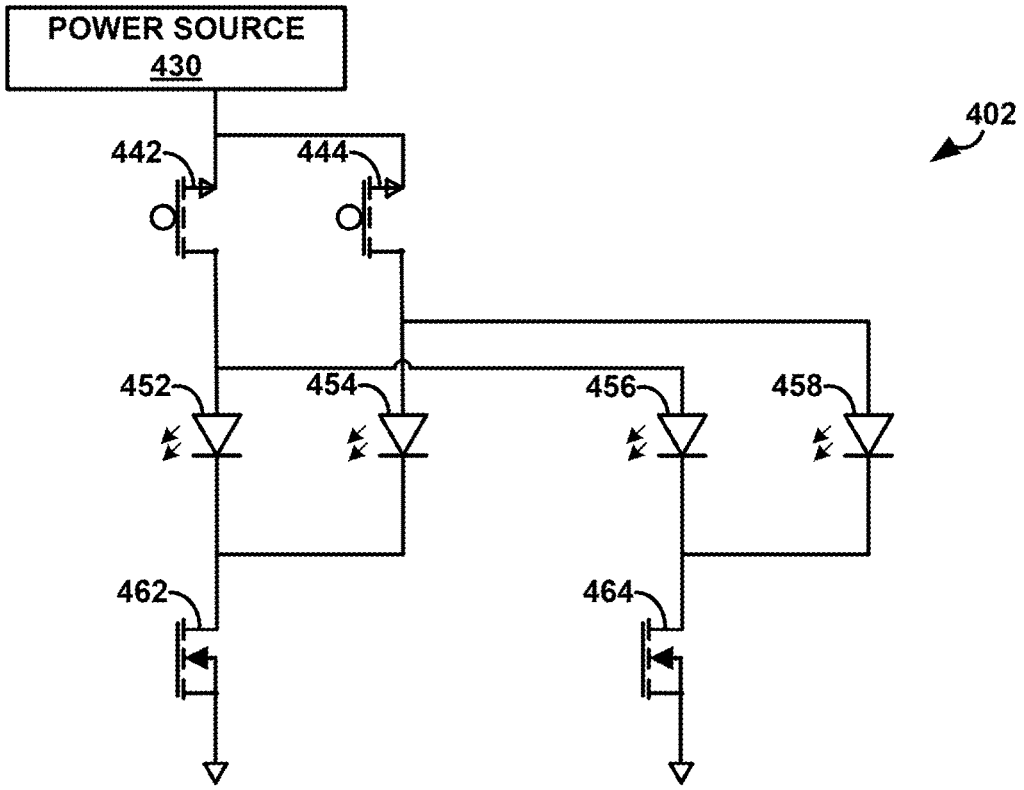
FIG. 6A is a conceptual diagram illustrating an example system 402 including an LED channel comprising four LEDs, in accordance with one or more techniques of this disclosure.

FIG. 6A is a conceptual diagram illustrating an example system 402 including an LED channel comprising four LEDs, in accordance with one or more techniques of this disclosure. As seen in FIG. 6A, system 402 includes power source 430, high side switching devices 442, 444, LEDs 452, 454, 456, 458, and low side switching devices 462, 464. Although LED channels 139 of FIGS. 1-2 each include one LED and one switching device, this is not the only possible configuration for an LED channel. An LED channel may include more than one LED and/or more than one switching device.

In some examples, when high side switching device 442 is activated and low side switching device 462 is activated, LED 452 may be turned on an emit light. When one or both of high side switching device 442 and low side switching device 462 is deactivated, LED 452 may be turned off. When high side switching device 444 is activated and low side switching device 462 is activated, LED 454 may be turned on an emit light. When one or both of high side switching device 444 and low side switching device 462 is deactivated, LED 454 may be turned off. In some examples, when high side switching device 442 is activated and low side switching device 464 is activated, LED 456 may be turned on an emit light. When one or both of high side switching device 442 and low side switching device 464 is deactivated, LED 456 may be turned off. When high side switching device 444 is activated and low side switching device 464 is activated, LED 458 may be turned on an emit light. When one or both of high side switching device 444 and low side switching device 464 is deactivated, LED 458 may be turned off. Consequently, an LED driver may be configured to individually control whether each LED of LEDs 452, 454, 456, 458 is turned on or turned off by controlling high side switching devices 442, 444 and low side switching devices 462, 464.

Figure 6B:
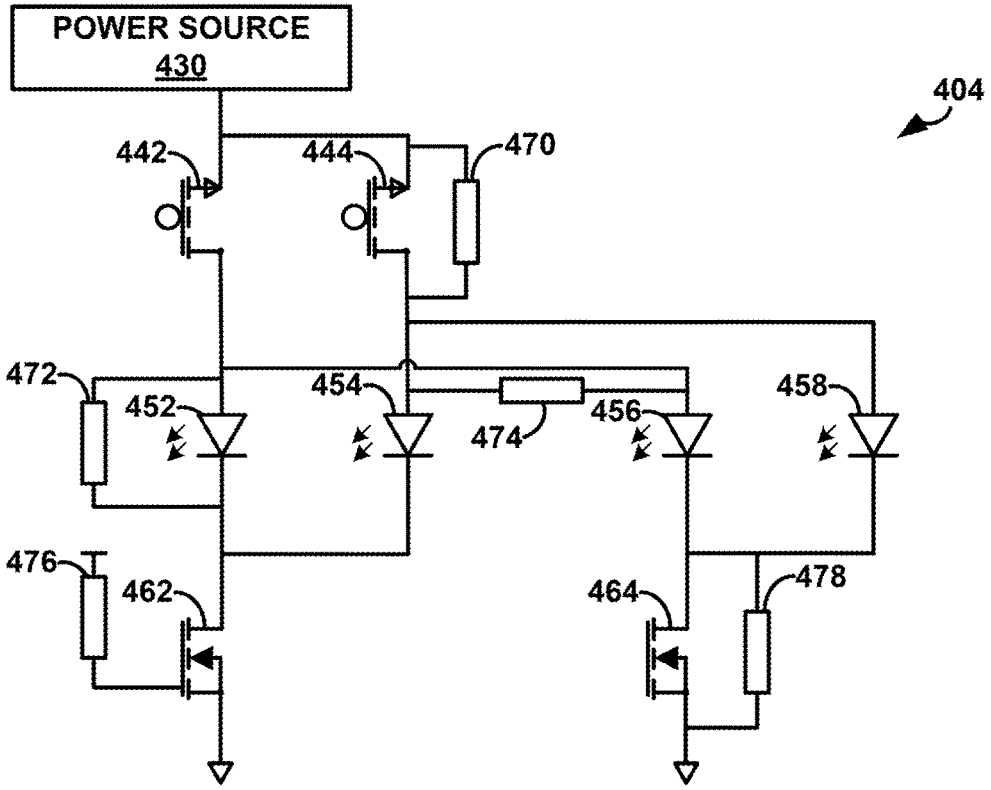
FIG. 6B is a conceptual diagram illustrating an example system 404 including an LED channel comprising four LEDs and one or more short connections, in accordance with one or more techniques of this disclosure.

FIG. 6B is a conceptual diagram illustrating an example system 404 including an LED channel comprising four LEDs and one or more short connections, in accordance with one or more techniques of this disclosure. System 404 of FIG. 6B may be substantially the same as system 404 of FIG. 4A, except that system 404 includes short connections 470-478. In some examples, one or more short connections may inhibit an LED channel such that the LED channel does not operate in a desired fashion. For example, a short connection may cause an LED to emit light when an LED driver is controlling the LED to be turned off, or cause an LED to be turned off when an LED driver is controlling the LED to be turned on and emit light. Short connections 470-478 are examples of short connections that may disrupt a desired operation of the LED channel.

Short connection 470 may create an alterative pathway for electrical current to circumvent high side switching device 444 even when high side switching device 444 is deactivated. This may cause LED 454 and/or LED 458 to be turned on and emit light even when one or more controllers are controlling LED 454 and/or LED 458 to be turned off. For example, when short connection 470 is not present, electrical current cannot reach LED 454 and LED 458, and therefore LED 454 and LED 458 are turned off. But when short connection 470 is present, electrical current may reach LED 454 and LED 458 even when one or more controllers cause high side switching device 444 to be turned off. This means that when low side switching device 462 is activated and high side switching device 444 is deactivated, LED 454 may emit light because electrical current may cross short connection 470 to reach LED 454. When low side switching device 464 is activated and high side switching device 444 is deactivated, LED 458 may emit light because electrical current may cross short connection 470 to reach LED 458.

Short connection 472 may create an alternative pathway for electrical current to bypass LED 452. Short connection 472 may cause LED 452 to emit a lower than desirable amount of light as compared with a system where short connection 472 is not present. For example, when high side switching device 442 and low side switching device 462 are both activated, electrical current may flow from power source 430 across LED 452, causing LED 452 to emit light. When short connection 472 is present, at least some of the current flowing from power source 430 may flow across short connection 472 instead of flowing across LED 452. This may cause LED 452 to emit a lower amount of light as compared with a system where short connection 472 is not present.

Short connection 474 may create an alternative pathway that diverts electrical current meant to travel to LED 454. As seen in FIG. 6B, short connection 474 diverts the electrical current to LED 456. This means that short connection 474 affects two LEDs, LED 454, and LED 456. Short connection 474 may cause LED 454 to emit a lower amount of light as compared with systems where short connection 474 is not present. For example, when both high side switching device 444 and low side switching device 462 are both activated, electrical current may flow from power source 430 to LED 454. When short connection 474 is present, at least some of the electrical current may flow to LED 456 without passing through LED 454, thus decreasing an amount of light emitted by LED 454.

Additionally, or alternatively, short connection 474 may cause LED 456 to emit a greater amount of light as compared with a system where short connection 474 is not present. For example, short connection 474 may divert electrical current to LED 456 that is intended to flow through LED 454. When high side switching device 442 is deactivated and high side switching device 444 is activated, electrical current meant to flow through LED 454 may instead be diverted to LED 456, causing LED 456 to emit light even when a desired status of LED 456 is to be turned off. When high side switching device 442 and high side switching device 444 are both activated, electrical current may in some cases travel to both LED 454 and LED 456. Short connection 474 may divert at least some of the electrical current meant for LED 454, causing LED 454 to emit less than a desired amount of light and causing LED 456 to emit more than a desired amount of light.

Short connection 476 may create an alternative pathway that diverts electrical current meant to flow to a gate terminal of low side switching device 462. This may cause low side switching device 462 to be deactivated even when an LED driver sends control signals for activating low side switching device 462. For example, at least some of the electrical current of the control signals may flow to ground instead of flowing to the gate terminal of low side switching device 462, thus decreasing a voltage at the gate terminal of low side switching device 462 and deactivating low side switching device 462. When low side switching device 462 is deactivated even when low side switching device 462 is meant to be activated, LED 452 and/or LED 454 may be turned off even when LED 452 and/or LED 454 are meant to be emitting light.

Short connection 478 may create an alternative pathway that diverts electrical current across low side switching device 464. For example, when short connection 474 is not present, low side switching device 464 may prevent electrical current from flowing across LED 456 and LED 458 when low side switching device 464 is deactivated. Short connection 478 may provide a pathway for electrical current to flow across LED 458 and circumvent low side switching device 464, meaning that LED 458 may emit light even when low side switching device 464 is deactivated.

A presence of one or more short connections 470-478 as seen in system 404 may cause one or more error conditions to be present in the LED channel corresponding to system 402. Short connections 470-478 are examples of short connections that can arise in system 402. The techniques described herein are not meant to be limited to short connections 470-478. One or more other short connections may occur. System 404 includes short connections 470-478 for illustrative purposes, but it is not required for a system to exhibit every one of short connections 470-478. A system may exhibit any one or combination of short connections 470-478 and/or additional short connections not illustrated in FIG. 6B.

FIG. 7 is a conceptual diagram illustrating a table 700 indicating a set of LED channel status conditions 702-714, in accordance with one or more techniques of this disclosure. LED channel status conditions 702-714 may represent status conditions of an LED channel having four LEDs, as seen in FIGS. 6A-6B In some examples, one or more of LED channel status conditions 702-714 may be caused by one or more of short connections 470-478 of FIG. 6B. In some examples, One or more of LED channel status conditions 702-714 may be caused by factors other than short connections 470-478 of FIG. 6B.

LED channel status condition 702 may represent a "normal" status condition of the LED channel illustrated in FIG. 6A. For example, LED channel status condition 702 may represent the desired status condition of the LED channel, meaning that one or more controller(s) are configured to control LED(s) 452-458 to achieve a desired output of LED(s) 452-458, without any short connections causing LED(s) 452-458 to exhibit any error conditions.

LED channel status condition 702 may represent an error condition caused by short connection 472. LED channel status condition 704 may represent an error condition caused by no current across LED 452. LED channel status condition 706 may represent an error condition caused by short connection 470. LED channel status condition 708 may represent an error condition caused by short connection 478. LED channel status condition 710 may represent an error condition caused by a low side short to ground. LED channel status condition 712 may represent an error condition caused by a high side short to ground. LED channel status condition 714 may represent an error condition caused by a low side short to battery.

Figure 8:
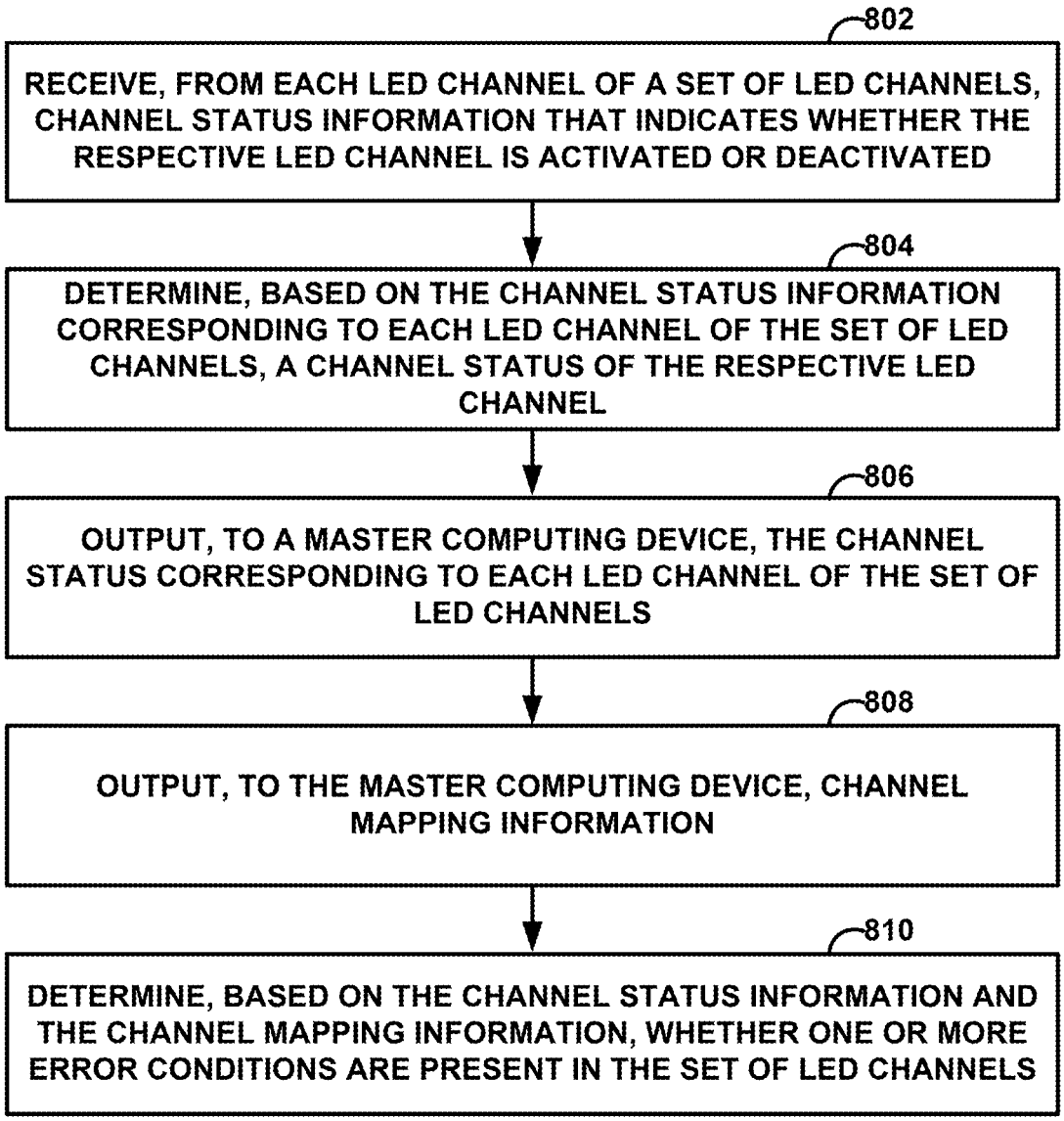
FIG. 8 is a flow diagram illustrating an example technique for identifying one or more error conditions present in an LED channel based on channel status information, in accordance with one or more techniques of this disclosure.

FIG. 8 is a flow diagram illustrating an example technique for identifying one or more error conditions present in an LED channel based on channel status information, in accordance with one or more techniques of this disclosure. FIG. 8 is described with respect to systems 100 and 102 of FIGS. 1-2. However, the techniques of FIG. 8 may be performed by different components of systems 100 and 102 or by additional or alternative systems.

As shown in FIG. 8, LED driver circuit 120 may be configured to receive, from each LED channel of a set of LED channels 139, channel status information that indicates whether the respective LED channel is activated or deactivated (802). The channel status information may, in some examples, include information from one or more sensors of each LED channel of the set of LED channels 139. LED driver circuit 120 may determine, based on the channel status information corresponding to each LED channel of the set of LED channels, a channel status of the respective LED channel (804).

LED driver circuit 120 may output, to master computing device 110, the channel status corresponding to each LED channel of the set of LED channels 139 (806). LED driver circuit 120 may additionally or alternatively output, to the master computing device 110, the channel status information received from each LED channel of the set of LED channels 139. LED driver circuit 120 may output, to master computing device 110, channel mapping information (808). In some examples, the channel mapping information indicates an LED driver of a set of LED drivers 124 corresponding to each LED channel of the set of LED channels 139. Master computing device 110 may determine, based on the channel status information and the channel mapping information, whether one or more error conditions are present in the set of LED channels (810).

The following numbered clauses may demonstrate one or more aspects of the disclosure.

Clause 1: An LED driver circuit configured to: control a set of LED channels; receive, from each LED channel of the set of LED channels, channel status information that indicates whether the respective LED channel is activated or deactivated; determine, based on the channel status information corresponding to each LED channel of the set of LED channels, a channel status of the respective LED channel; output, to a master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

Clause 2: The circuit of clause 1, wherein to receive the channel status information, the LED driver circuit is configured to: receive, from each LED channel of the set of LED channels, a gate signal that indicates whether a gate terminal of a switching device of the respective LED channel is activated or deactivated; receive, from each LED channel of the set of LED channels, an output voltage signal that indicates a voltage output from an LED of the respective LED channel; and receive, from each LED channel of the set of LED channels, an LED voltage signal that indicates a voltage across an LED of the respective LED channel.

Clause 3: The circuit of clause 2, wherein the LED driver circuit is configured to determine the channel status for each LED channel of the set of LED channels based on the gate signal, output voltage signal, and LED voltage signal corresponding to the respective LED channel of the set of LED channels.

Clause 4: The circuit of any of clauses 1-2, wherein to determine whether one or more error conditions are present in the set of LED channels, the master computing device is configured to: translate the channel mapping information into desired channel status information, wherein the desired channel status information indicates one or more LED channel status parameters for achieving a desired output corresponding to the set of LED channels; and compare the channel status information with the desired channel status information to determine whether the one or more error conditions are present in the set of LED channels.

Clause 5: The circuit of clause 4, wherein to control the set of LED channels, the LED driver circuit is configured to control whether each LED channel of the set of LED channels is activated or deactivated to achieve the desired output.

Clause 6: The circuit of any of clauses 4-5, wherein to control the set of LED channels, the LED driver circuit is configured to control a duty cycle corresponding to each LED channel of the set of LED channels so that the set of LED channels emits the desired output.

Clause 7: The circuit of any of clauses 1-6, further comprising one or more channel status sensors corresponding to each LED channel of the set of LED channels, wherein each LED channel of the set of LED channels comprises: a switching device connected in series with an LED; and one or more channel status sensors, wherein the LED driver circuit is configured to receive the channel status information from the one or more channel status sensors, and wherein to control the set of LED channels, the LED driver circuit is configured to control a gate terminal of the switching device of each LED channel of the set of LED channels.

Clause 8: The circuit of any of clauses 1-7, wherein the channel mapping information indicates a desired color corresponding to each LED channel of the set of LED channels with red, green, and blue (RGB) color data.

Clause 9: The circuit of any of clauses 1-8, wherein the channel mapping information indicates a physical position corresponding to each LED channel of the set of LED channels.

Clause 10: The circuit of any of clauses 1-9, wherein the channel mapping information indicates a desired color corresponding to each LED channel of the set of LED channels with RGB color data, and wherein the channel mapping information indicates a physical position corresponding to each LED channel of the set of LED channels.

Clause 11: The circuit of any of clauses 1-10, wherein based on determining that the one or more error conditions are present in the set of LED channels, the master computing device is configured to output information indicating the one or more error conditions.

Clause 12: The circuit of clause 11, wherein the information indicating the one or more error conditions indicates a source of each error condition of the one or more error conditions.

Clause 13: The circuit of any of clauses 1-12, wherein the master computing device is further configured to: identify one or more LED channels of the set of LED channels corresponding to the one or more error conditions present in the set of LED channels; and deactivate the one or more LED channels.

Clause 14: The circuit of clause 13, wherein to deactivate the one or more LED channels, the master computing device is configured to disconnect each LED channel of the one or more LED channels from a power source.

Clause 15: The circuit of any of clauses 13-14, wherein to deactivate the one or more LED channels, the master computing device is configured to activate a safety switch corresponding to each LED channel of the one or more LED channels.

Clause 16: The circuit of any of clauses 1-15, wherein the channel status information comprises automotive safety integrity level (ASIL) channel status information, wherein the channel mapping information comprises ASIL channel mapping information, and wherein the driver circuit device is configured to output the ASIL channel status information and the ASIL channel mapping information including one or more data protection mechanisms.

Clause 17: A method comprising: controlling, by an LED driver circuit, a set of LED channels; receiving, by the LED driver circuit from each LED channel of the set of LED channels, channel status information that indicates whether the respective LED channel is activated or deactivated; determining, by the LED driver circuit based on the channel status information corresponding to each LED channel of the set of LED channels, a channel status of the respective LED channel; outputting, by the LED driver circuit to a master computing device, the channel status corresponding to each LED channel of the set of LED channels; outputting, by the LED driver circuit to the master computing device, channel mapping information, wherein the channel mapping information indicates an LED driver of a set of LED drivers corresponding to each LED channel of the set of LED channels; and determining, by the master computing device based on the channel status information and the channel mapping information, whether one or more error conditions are present in the set of LED channels.

Clause 18: The method of clause 17, wherein receiving the channel status information comprises: receiving, by the LED driver circuit from each LED channel of the set of LED channels, a gate signal that indicates whether a gate terminal of a switching device of the respective LED channel is activated or deactivated; receiving, by the LED driver circuit from each LED channel of the set of LED channels, an output voltage signal that indicates a voltage output from an LED of the respective LED channel; and receiving, by the LED driver circuit from each LED channel of the set of LED channels, an LED voltage signal that indicates a voltage across an LED of the respective LED channel.

Clause 19: The method of clause 18, wherein the method further comprises determining, by the LED driver circuit, the channel status for each LED channel of the set of LED channels based on the gate signal, output voltage signal, and LED voltage signal corresponding to the respective LED channel of the set of LED channels.

Clause 20: The method of any of clauses 17-19, wherein determining whether one or more error conditions are present in the set of LED channels comprises: translating, by the master computing device, the channel mapping information into desired channel status information, wherein the desired channel status information indicates one or more LED channel status parameters for achieving a desired output corresponding to the set of LED channels; and comparing, by the master computing device, the channel status information with the desired channel status information to determine whether the one or more error conditions are present in the set of LED channels.

Clause 21: A system comprising: a set of LED channels; a master computing device; and an LED driver circuit configured to: control the set of LED channels; receive, from each LED channel of the set of LED channels, channel status information that indicates whether the respective LED channel is activated or deactivated; determine, based on the channel status information corresponding to each LED channel of the set of LED channels, a channel status of the respective LED channel; output, to the master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

The techniques described in this disclosure may be implemented, at least in part, in hardware, software, firmware or any combination thereof. For example, various aspects of the described techniques may be implemented within one or more processors, including one or more microprocessors, DSPs, ASICs, FPGAs, or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit comprising hardware may also perform one or more of the techniques of this disclosure.

Such hardware, software, and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components, or integrated within common or separate hardware or software components.

The techniques described in this disclosure may also be embodied or encoded in a computer-readable medium, such as a computer-readable storage medium, containing instructions. Instructions embedded or encoded in a computer-readable storage medium may cause a programmable processor, or other processor, to perform the method, e.g., when the instructions are executed. Computer readable storage media may include RAM, ROM, programmable read only memory (PROM), erasable programmable read only memory (EPROM), EEPROM, flash memory, a hard disk, a CD-ROM, a floppy disk, a cassette, magnetic media, optical media, or other computer readable media.

Various examples have been described. These and other examples are within the scope of the following claims.

What is claimed is:

1. A light-emitting diode (LED) driver circuit configured to:

control a set of LED channels;

receive, from each LED channel of the set of LED channels, channel status information that indicates whether the respective LED channel is activated or deactivated;

determine, based on the channel status information corresponding to each LED channel of the set of LED channels, a channel status of the respective LED channel;

output, to a master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

2. The circuit of claim 1, wherein to receive the channel status information, the LED driver circuit is configured to:

receive, from each LED channel of the set of LED channels, a gate signal that indicates whether a gate terminal of a switching device of the respective LED channel is activated or deactivated;

receive, from each LED channel of the set of LED channels, an output voltage signal that indicates a voltage output from an LED of the respective LED channel; and receive, from each LED channel of the set of LED channels, an LED voltage signal that indicates a voltage across an LED of the respective LED channel.

3. The circuit of claim 2, wherein the LED driver circuit is configured to determine the channel status for each LED channel of the set of LED channels based on the gate signal, output voltage signal, and LED voltage signal corresponding to the respective LED channel of the set of LED channels.

4. The circuit of claim 1, wherein to determine whether one or more error conditions are present in the set of LED channels, the master computing device is configured to:

translate the channel mapping information into desired channel status information, wherein the desired channel status information indicates one or more LED channel status parameters for achieving a desired output corresponding to the set of LED channels; and compare the channel status information with the desired channel status information to determine whether the one or more error conditions are present in the set of LED channels.

5. The circuit of claim 4, wherein to control the set of LED channels, the LED driver circuit is configured to control whether each LED channel of the set of LED channels is activated or deactivated to achieve the desired output.

6. The circuit of claim 4, wherein to control the set of LED channels, the LED driver circuit is configured to control a duty cycle corresponding to each LED channel of the set of LED channels so that the set of LED channels emits the desired output.

7. The circuit of claim 1, further comprising one or more channel status sensors corresponding to each LED channel of the set of LED channels, wherein each LED channel of the set of LED channels comprises:

a switching device connected in series with an LED; and one or more channel status sensors, wherein the LED driver circuit is configured to receive the channel status information from the one or more channel status sensors, and wherein to control the set of LED channels, the LED driver circuit is configured to control a gate terminal of the switching device of each LED channel of the set of LED channels.

8. The circuit of claim 1, wherein the channel mapping information indicates a desired color corresponding to each LED channel of the set of LED channels with red, green, and blue (RGB) color data.

9. The circuit of claim 1, wherein the channel mapping information indicates a physical position corresponding to each LED channel of the set of LED channels.

10. The circuit of claim 1, wherein the channel mapping information indicates a desired color corresponding to each LED channel of the set of LED channels with RGB color data, and wherein the channel mapping information indicates a physical position corresponding to each LED channel of the set of LED channels.

11. The circuit of claim 1, wherein based on determining that the one or more error conditions are present in the set of LED channels, the master computing device is configured to output information indicating the one or more error conditions.

12. The circuit of claim 11, wherein the information indicating the one or more error conditions indicates a source of each error condition of the one or more error conditions.

13. The circuit of claim 1, wherein the master computing device is further configured to:

identify one or more LED channels of the set of LED channels corresponding to the one or more error conditions present in the set of LED channels; and deactivate the one or more LED channels.

14. The circuit of claim 13, wherein to deactivate the one or more LED channels, the master computing device is configured to disconnect each LED channel of the one or more LED channels from a power source.

15. The circuit of claim 13, wherein to deactivate the one or more LED channels, the master computing device is configured to activate a safety switch corresponding to each LED channel of the one or more LED channels.

16. The circuit of claim 1, wherein the channel status information comprises automotive safety integrity level (ASIL) channel status information, wherein the channel mapping information comprises ASIL channel mapping information, and wherein the driver circuit device is configured to output the ASIL channel status information and the ASIL channel mapping information including one or more data protection mechanisms.

17. A method comprising:

controlling, by a light-emitting diode (LED) driver circuit, a set of LED channels;

receiving, by the LED driver circuit from each LED channel of the set of LED channels, channel status information that indicates whether the respective LED channel is activated or deactivated;

determining, by the LED driver circuit based on the channel status information corresponding to each LED channel of the set of LED channels, a channel status of the respective LED channel;

outputting, by the LED driver circuit to a master computing device, the channel status corresponding to each LED channel of the set of LED channels;

outputting, by the LED driver circuit to the master computing device, channel mapping information, wherein the channel mapping information indicates an LED driver of a set of LED drivers corresponding to each LED channel of the set of LED channels; and determining, by the master computing device based on the channel status information and the channel mapping information, whether one or more error conditions are present in the set of LED channels.

18. The method of claim 17, wherein receiving the channel status information comprises:

receiving, by the LED driver circuit from each LED channel of the set of LED channels, a gate signal that indicates whether a gate terminal of a switching device of the respective LED channel is activated or deactivated;

receiving, by the LED driver circuit from each LED channel of the set of LED channels, an output voltage signal that indicates a voltage output from an LED of the respective LED channel; and receiving, by the LED driver circuit from each LED channel of the set of LED channels, an LED voltage signal that indicates a voltage across an LED of the respective LED channel.

19. The method of claim 18, wherein the method further comprises determining, by the LED driver circuit, the channel status for each LED channel of the set of LED channels based on the gate signal, output voltage signal, and LED voltage signal corresponding to the respective LED channel of the set of LED channels.

20. The method of claim 17, wherein determining whether one or more error conditions are present in the set of LED channels comprises:

translating, by the master computing device, the channel mapping information into desired channel status information, wherein the desired channel status information indicates one or more LED channel status parameters for achieving a desired output corresponding to the set of LED channels; and comparing, by the master computing device, the channel status information with the desired channel status information to determine whether the one or more error conditions are present in the set of LED channels.

21. A system comprising:

a set of light-emitting diode (LED) channels;

a master computing device; and an LED driver circuit configured to:

control the set of LED channels;

receive, from each LED channel of the set of LED channels, channel status information that indicates whether the respective LED channel is activated or deactivated;

determine, based on the channel status information corresponding to each LED channel of the set of LED channels, a channel status of the respective LED channel;

output, to the master computing device, the channel status corresponding to each LED channel of the set of LED channels; and output, to the master computing device, channel mapping information, wherein the channel mapping information indicates an LED driver of a set of LED drivers corresponding to each LED channel of the set of LED channels, wherein the master computing device is configured to determine, based on the channel status information and the channel mapping information, whether one or more error conditions are present in the set of LED channels.

* * * * *